US005542678A

United States Patent [19]

Woodbridge

[11] Patent Number: 5,542,678

[45] Date of Patent: Aug. 6, 1996

[54] CHESS AND CHECKERS GAME PIECES HAVING SELECTABLE INDICIA

[76] Inventor: M. Josephine Woodbridge, 248 N. Adam St., Lockport, N.Y. 14094

[21] Appl. No.: 378,836

[22] Filed: Jan. 26, 1995

[51] Int. Cl.[6] ..... A63F 3/00

[52] U.S. Cl. ..... 273/260; 273/288; 273/291

[58] Field of Search ..... 273/260, 261, 273/288, 290, 291

[56] References Cited

U.S. PATENT DOCUMENTS

| | | | |
|---|---|---|---|
| 191,223 | 5/1877 | Briggs . | |
| 509,316 | 11/1893 | Lapham . | |
| 663,249 | 12/1900 | Whitman . | |
| 1,221,493 | 4/1917 | Whitaker . | |
| 1,441,386 | 1/1923 | Truskoski . | |
| 2,847,222 | 8/1958 | Weeks | 273/288 X |
| 3,844,563 | 10/1974 | Isaac . | |
| 3,856,309 | 12/1974 | Helfgott | 273/288 |
| 3,947,040 | 3/1976 | Samuels | 273/288 |
| 4,188,035 | 2/1980 | Metzler | 273/288 X |
| 4,249,740 | 2/1981 | Cheney et al. | 273/288 X |
| 4,961,583 | 10/1990 | Koch et al. . | |
| 4,988,110 | 1/1991 | Zuckerman et al. . | |
| 5,160,145 | 11/1992 | Bokhagen | 273/288 X |
| 5,211,403 | 5/1993 | Ostrander | 273/288 X |

FOREIGN PATENT DOCUMENTS

| | | | |
|---|---|---|---|
| 2403095 | 5/1979 | France | 273/261 |
| 2632356 | 1/1978 | Germany | 273/288 |
| 350528 | 6/1931 | United Kingdom | 273/288 |
| 552934 | 4/1943 | United Kingdom | 273/288 |

*Primary Examiner*—William E. Stoll
*Attorney, Agent, or Firm*—Richard C. Woodbridge

[57] ABSTRACT

A promotional game, sold as a kit, permits the player to selectively assemble his or her own chess or checkers set. The kit comprises a case of fruit juice bottles further including a green and white checker/chessboard, an instructional book, and two sets of adhesive backed stickers. The first set comprises a set of checker stickers in which the checkers pieces include indicia in the form of fruit, preferably apples or pears, and in colors consistent with that fruit, for example, red and a dark color. The second set of stickers comprises adhesive backed indicia in the form of chess pieces also having a fruit theme where, for example, the pawns might be apples. The board and sticker indicia are preferably packaged on top of the bottles and shrink wrapped into position so that they are visible to the potential purchaser.

13 Claims, 3 Drawing Sheets

CHESS AND CHECKERS GAME PIECES HAVING SELECTABLE INDICIA

BACKGROUND OF THE INVENTION

1. Field of the Invention

Generally described the invention relates to a promotional package in which the purchaser is able to selectively convert fruit juice bottle caps into playing pieces suitable for playing chess or checkers.

2. Description of Related Art

Chess and checkers are ancient games that are well known to the general public. Because both are so popular, efforts have been made in the past to make reversible pieces so that chess or checkers can be selectively played on the same board. See, for example, the disclosures in the following U.S. Pat. Nos. 191,223; 509,316; 663,249; 1,221,493; and, 1,441,386. While the concept of reversible chess/checkers playing pieces is known to a limited extent, the approaches appear to have been relatively expensive and hard to implement. Accordingly, the concept of reversible checkers/chess playing pieces has never caught on to any great extent.

There is also some very limited discussion in the prior art of the concept of using common objects as playing pieces on a game board. See, for example, U.S. Pat. No. 4,961,583 in which "small drinking glasses" are used as playing pieces. Apparently the winner (or loser) has to drink a shot of whiskey each time he or she wins (or loses). Also, U.S. Pat. No. 4,988,110 describes the use of candy, or the like, as playing pieces. In general, the use of common objects are not satisfactory as playing pieces because they do not accurately portray real chess or checkers pieces very well.

There appears to be virtually no discussion in the prior art of the concept of using stickers in the form of adhesive backed indicia for the purpose of selectively marking common objects so that they can be used as playing pieces. U.S. Pat. No. 3,844,561 entitled "CHESS TYPE GAME WITH CHANGEABLE BOARD INDICIA" does, however, describe a board game which can be changed by placing new materials on top thereof.

In summary, the prior art does not appear to teach or suggest the concept of using adhesive backed stickers to convert common objects, specifically fruit juice bottle caps, into believable chess and checkers pieces which can be inexpensively sold and distributed as part of a promotion with cases of fruit juice, or the like.

SUMMARY OF THE INVENTION

Briefly described, the invention comprises a promotional kit in which a case of fruit juice containers, typically including twenty-four bottles with caps, also includes a chess/checkers board, an instructional book, and at least two separate sets of stickers so that the bottle caps can be converted selectively into either chess or checkers pieces. A case of twenty-four bottles of apple juice is typically sold in a shrink wrapped package. According to the preferred embodiment of the invention, a chess/checkers board, preferably having the color of green and white to suggest its relationship to the environment, is placed on top of the fruit juice bottles along with two sets of adhesive backed stickers and, perhaps, a set of instructions. The first set of stickers comprises a group of twenty-four adhesive backed stickers having checker indicia thereon. Apples or pears, with appropriate red or black colors, and maybe including a green leaf for accent, simulate conventional checker pieces. The second set of stickers are in the form of simulated chess players, also suggestive of apples or pears, with the pawns in the form of the fruit. Instructions, accompanying the package, inform the purchaser to remove the appropriate stickers and, if he or she wants to play checkers, to stick the twenty-four checker stickers on top of the twenty-four bottle caps, after the bottles have been emptied. The player then can proceed to play checkers in the regular fashion on the checkers board provided with the kit. Alternatively, the player may use the thirty-two chess stickers to convert the bottle caps into chess pieces. Because a typical case of apple juice only includes twenty-four bottles, the purchaser may have to acquire a second case of bottles in order to have enough bottle caps to use all of the thirty-two chess stickers. The player then proceeds to play chess according to standard rules on the checkers board provided.

These and other features of the invention may be more fully understood by reference to the following drawings.

DETAILED DESCRIPTION OF THE INVENTION

During the course of this description like numbers will be used to identify the same elements according to the different view of the invention provided.

Figure 1A:
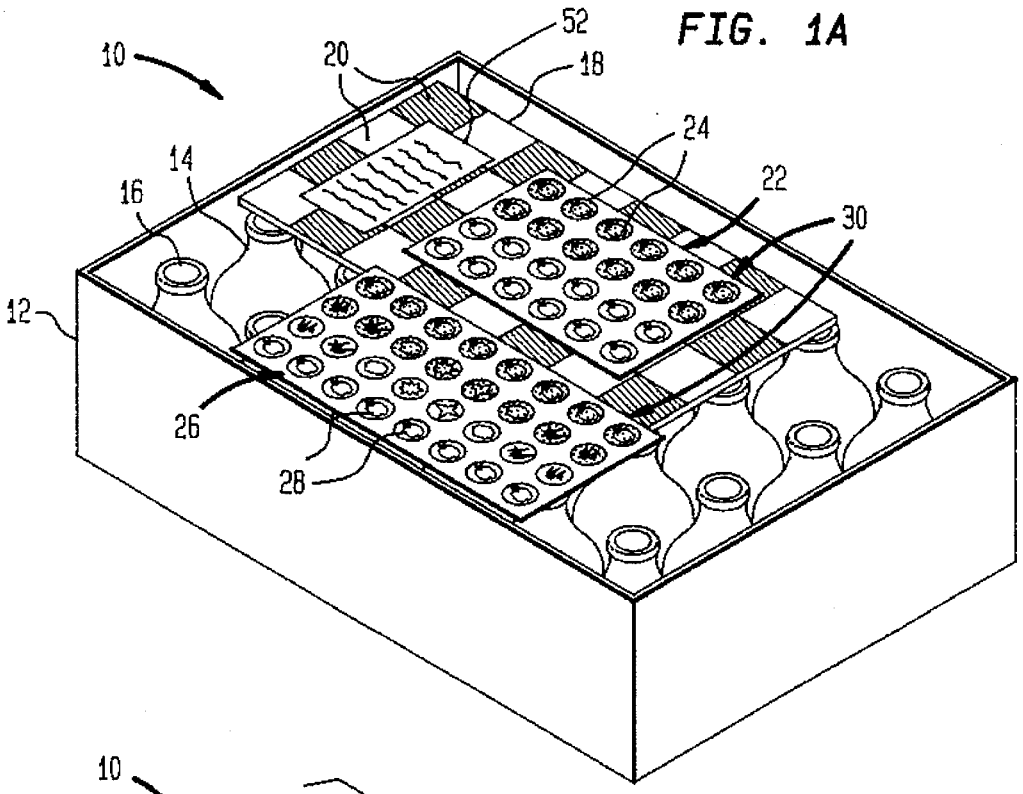
FIG. 1A illustrates the preferred embodiment of the kit apparatus prior to the case of fruit juice bottles being unpackaged.

The invention 10 is illustrated in its packaged state in FIG. 1A. A conventional cardboard case 12, or the like, contains twenty-four bottles 14 of apple juice in the conventional manner. Each of the twenty-four bottles 14 includes a conventional twist-off cap 16 having a diameter of approximately one and three-quarters inches—not much different than the size of a conventional checker piece or the base diameter of a chess piece. A game board 18 is located on top of the bottles 14 as are two separate sets 30 of stickers. In addition, an instruction manual 52 may be included as well. It might also be possible to include stickers for other games such as pog. The package is typically bound together with shrink wrap so that the playing board 18, the two sets of stickers 30, and the instructions 52 are visible to the purchaser. In this manner, the potential purchaser is made aware of the promotional give away.

Figure 1B:
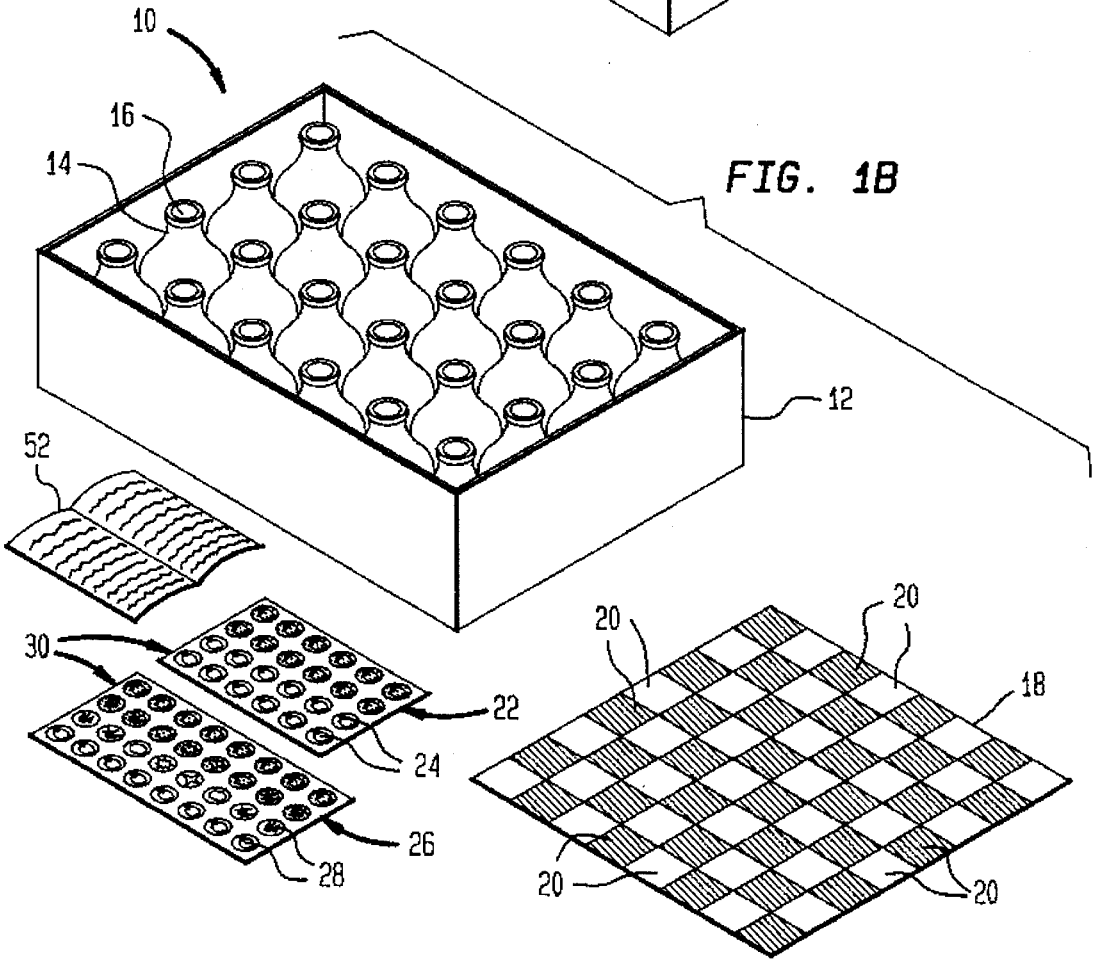
FIG. 1B illustrates the kit apparatus of FIG. 1A after it has been unwrapped and its contents separated.

FIG. 1B illustrates the invention 10 after the kit has been unpacked. The playing board 18 is unfolded and the squares 20 illustrated. Because of the organic nature of the apple juice in the bottles, alternate squares 20 of the playing board 18 would preferably be in environmental colors such as green and white.

Figure 2:
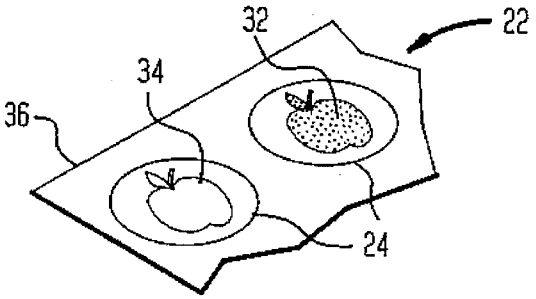
FIG. 2 illustrates a partial, close-up view of the checkers stickers.
Figure 6:
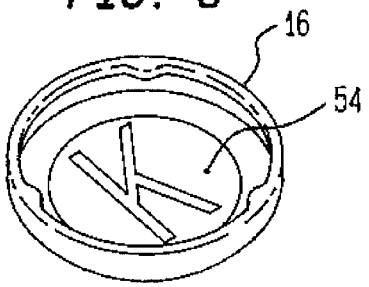
FIG. 6 illustrates a single bottle cap with a sticker placed on the inside thereof to indicate that it is a "king" checker piece.

The two sets 30 of stickers comprise a first set 22 and a second set 26. First set 22 includes 24 stickers 24. Each of the stickers 24 is in the form of a checker piece illustrated in further detail in FIG. 2. A first group of twelve checker pieces 32 are in the form of simulated red apples whereas the second group of twelve checkers pieces 34 are in the form of white apples. The red apples 32 and white apples 34 might include, for example, a green leaf for accent purposes. Additional "king" stickers 54 as illustrated in FIG. 6 may be provided to permit a single bottle cap to act as a king checker piece. This may be done because bottle caps do not stack well on each other. Stickers 32 and 34 are carried on a conventional release backing sheet 36 and are weakly adhered thereto in the well known conventional manner by adhesive. The diameter of the stickers 32 and 34 are slightly less than the one and three-quarters inch diameter of the bottle caps 16. When the twenty-four stickers 32 and 34 are removed from the release layer 36 and placed upon the bottle cap bases 16, they form very realistic checker pieces with an apple fruit theme that connects it attractively with the apple juice sold in the case 12.

Figure 3:
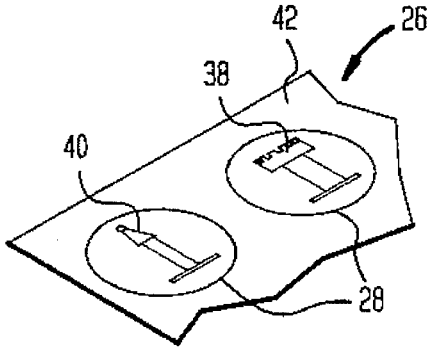
FIG. 3 illustrates a partial, close-up view of the chess stickers.

The second set of stickers 26 include thirty-two adhesive backed stickers 28 in the form of chess pieces as further illustrated in FIG. 3. A conventional chess game includes thirty-two pieces, therefore, one-half, namely 16, of the stickers 28 will be of a first color, preferably red, and the second group of 16 stickers 28 will be of a second color, preferably white. The pawns 56 would preferably be in the form of red or white apples, perhaps similar to those of the checker pieces 32 and 34 illustrated in FIG. 2, and the remaining players, i.e., King, Queen, Rook, Bishop and Knight, might also have an apple-like theme to them. The thirty-two stickers 38 and 40 are weakly adhesively attached to a release layer 42. If the purchaser of the kit 10 decides to play chess rather than checkers, then he or she would remove the thirty-two chess stickers 38 and 40 and selectively place them on bottle caps 16 in the manner previously described with regard to the checkers stickers 32 and 34.

Figure 4:
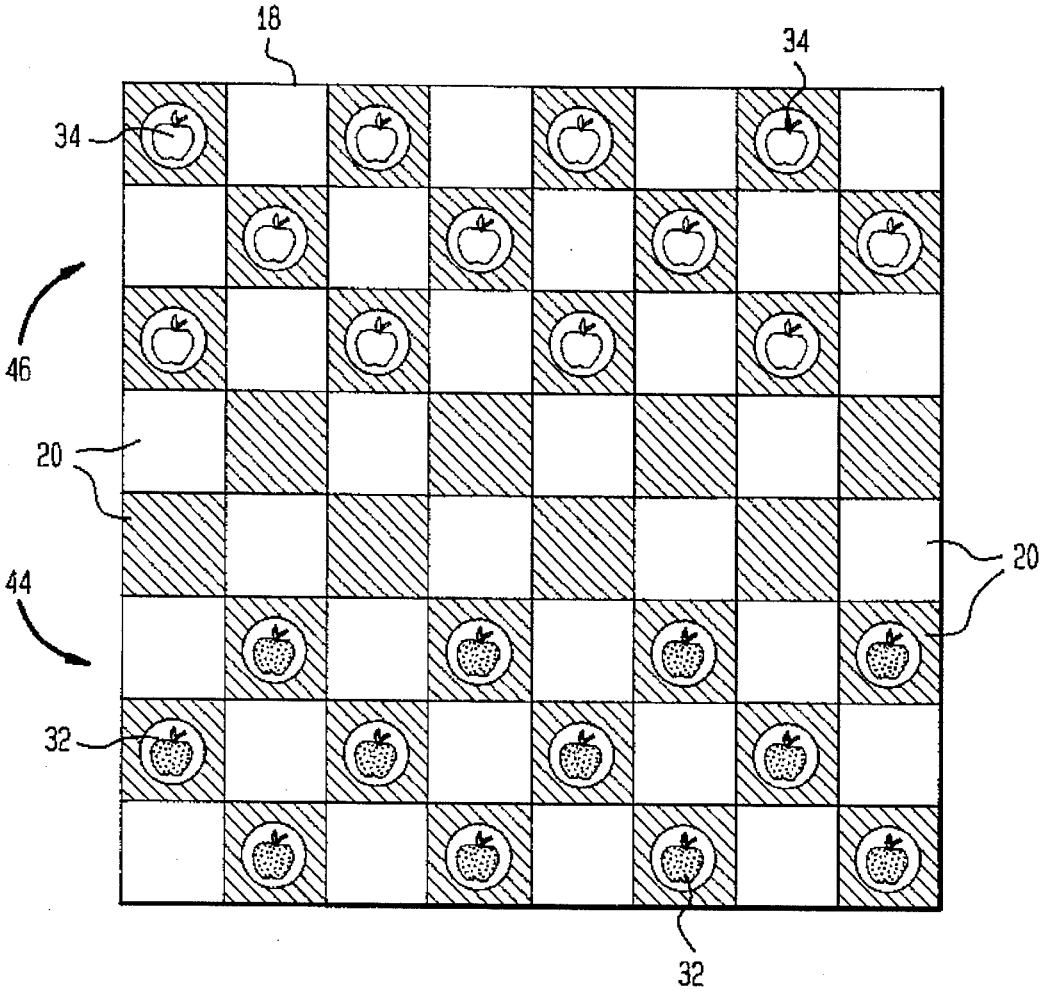
FIG. 4 illustrates the manner in which the twenty-four checkers stickers, after they have been placed on bottle caps, are employed as checker pieces on the game board provided.

FIG. 4 illustrates the use of the stickers 24 in order to convert the bottle caps 16, which act like a base, into two believable groups 44 and 46 of twelve checker pieces with stickers 32 and 34. The size of the bottle caps, because they are so close to the size of conventional checkers pieces, give the game a very realistic appearance. Also, because the indicia on the checkers pieces 44 and 46 are in the form of apples, it gently reminds the player of the desirability of the apple juice and, hopefully, encourages the player to purchase more.

Figure 5:
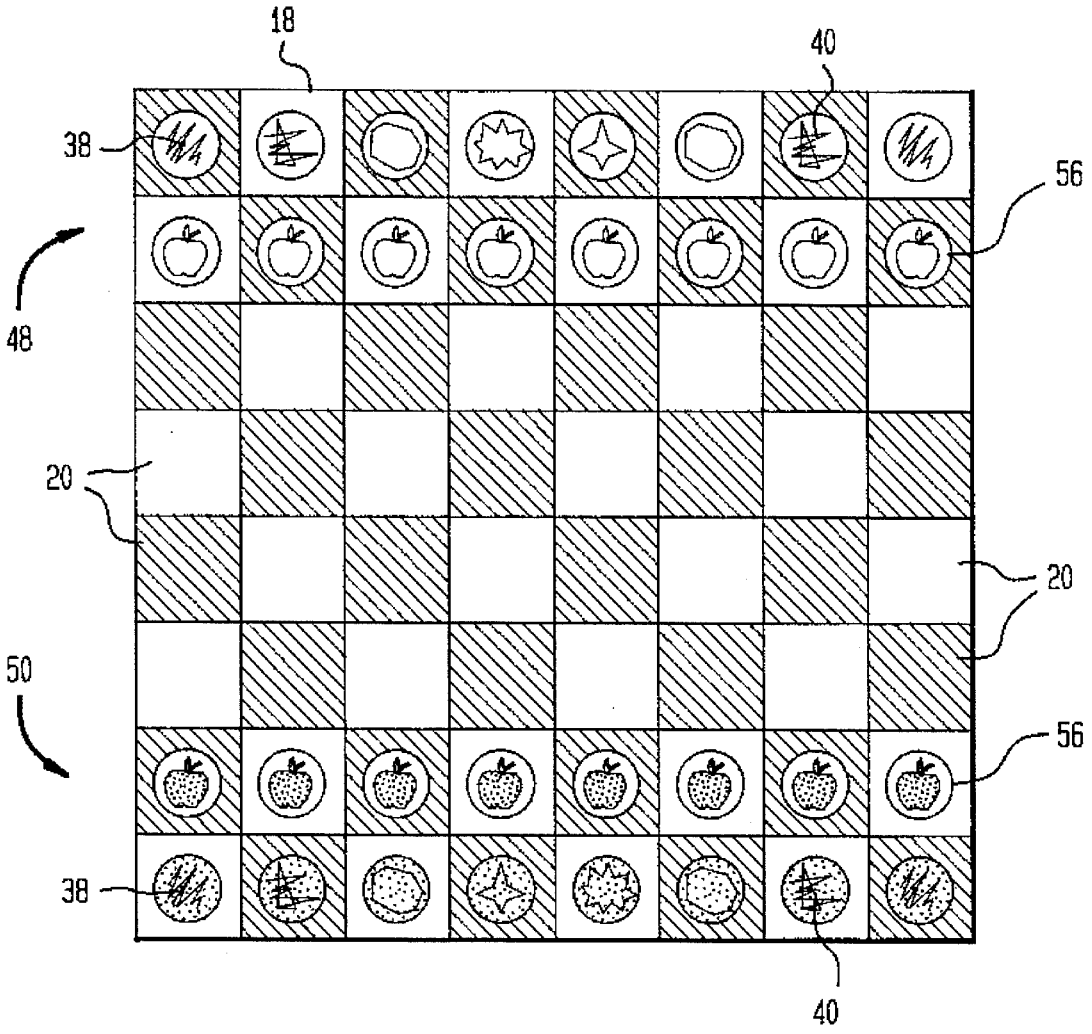
FIG. 5 illustrates how the thirty-two chess stickers, after they have been placed on the bottle caps, are employed as chessmen as part of a conventional chess game played on the game board provided.

FIG. 5 illustrates the invention in which the bottle cap bases 16 have been converted by means of stickers 38 and 40 into two groups of believable chess pieces 48 and 50. The chess game is then played in the conventional fashion.

FIG. 6 illustrates an alternative embodiment in which a king sticker 54 is placed on the inside of a bottle cap 16 in order that a single bottle cap 16 can act simultaneously as a single checker piece or a king. This is done because the bottle caps 16 are slippery and do not stack well. Alternatively, chess stickers left over from set 26 could be used on the inside of cap 16 as a pseudo king sticker 54.

The invention 10 has several major advantages.

First, it is relatively inexpensive to manufacture.

Second, it is a very effective promotion, especially for fruit juice products because the bottle caps 16 are so close in size to conventional checkers pieces.

Third, the kit invention 10 lends itself to playing at least two games, namely chess and checkers, using the same bottle caps 16 as base pieces. It is conceivable that other games, like pog, in addition to chess and checkers, might be played also.

Fourth, because the pawns of the chess pieces are similar to the checkers pieces, it is possible, though not necessarily desirable, to reuse the chess pawns as checkers pieces.

Fifth, the materials are environmentally friendly because the bottle caps and the playing pieces form a single unit that can be disposed of in the normal fashion rather than disposing of bottle caps and separate player pieces.

While the invention has been described with reference to the preferred embodiment thereof, it will be appreciated by those of ordinary skill in the art that various modifications can be made to the parts that comprise the invention without departing from the spirit and scope of the invention as a whole.

I claim:

1. A promotional board game apparatus sold as a kit comprising:

a case;

a plurality of juice bottles locatable in said case;

a plurality of juice bottle caps each locatable individually on top of said plurality of juice bottles;

a board having a plurality of playing squares thereon; and, a plurality of adhesive backed indicia means for selective attachment to said plurality of caps respectively, wherein attachment of said adhesive backed indicia means to said cap converts said cap into a playing piece suitable for playing a board game on said board.

2. The apparatus of claim 1 wherein said indicia means include indicia of checker pieces thereon.

3. The apparatus of claim 1 wherein said indicia means include indicia of chess pieces thereon.

4. The apparatus of claim 1 wherein said indicia means include indicia of chess and checkers thereon.

5. A board game apparatus comprising a kit, said apparatus comprising:

a board having a plurality of squares thereon;

a plurality of base pieces comprising fruit juice bottle caps;

a plurality of adhesive backed indicia means for selective attachment to said plurality of base pieces respectively;

a case;

a plurality of fruit juice bottles attachable to said fruit juice bottle caps; and, packaging means for holding said apparatus together, wherein attachment of said adhesive backed indicia means to said base pieces converts said base pieces into playing pieces suitable for playing a board game on said board and wherein said kit includes all of the elements necessary to play said board game.

6. The apparatus of claim 5 wherein said indicia means include indicia of checker pieces thereon.

7. The apparatus of claim 6 wherein said indicia means include indicia of chess pieces thereon.

8. The apparatus of claim 7 wherein said indicia means include indicia of chess and checker pieces thereon.

9. The apparatus of claim 8 wherein at least some of said indicia means include representations of fruit.

10. The apparatus of claim 9 wherein at least some of said indicia means include representations of apples.

11. The apparatus of claim 10 wherein said bottle caps have a top side and a bottom side connectable to said bottles and at least some of said indicia means are for attachment to the bottom side of said bottle caps.

12. The apparatus of claim 11 wherein said indicia means for attachment to the bottom side of said bottle caps indicate that the cap is meant to be a king checker piece.

13. The apparatus of claim 12 wherein at least some of said checker pieces can be used as pawn chess pieces.

* * * * *